US011345530B2

(12) United States Patent
Simpkins

(10) Patent No.: US 11,345,530 B2
(45) Date of Patent: May 31, 2022

(54) PACKAGING AND BLANKS THEREFOR

(71) Applicant: WestRock Shared Services, LLC, Atlanta, GA (US)

(72) Inventor: Kevin Simpkins, Cumming, GA (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 0 days.

(21) Appl. No.: 17/123,825

(22) Filed: Dec. 16, 2020

(65) Prior Publication Data

US 2021/0101729 A1 Apr. 8, 2021

Related U.S. Application Data

(62) Division of application No. 16/158,369, filed on Oct. 12, 2018, now Pat. No. 10,894,646.

(51) Int. Cl.

| | |
|---|---|
| ***B65D 75/06*** | (2006.01) |
| ***B65D 5/02*** | (2006.01) |
| ***B65D 5/04*** | (2006.01) |
| ***B65D 5/50*** | (2006.01) |
| ***B65D 85/20*** | (2006.01) |
| ***B65D 5/42*** | (2006.01) |

(52) U.S. Cl.

CPC ..... *B65D 75/06* (2013.01); *B65D 5/029* (2013.01); *B65D 5/0281* (2013.01); *B65D 5/04* (2013.01); *B65D 5/5004* (2013.01); *B65D 85/20* (2013.01); *B65D 5/0245* (2013.01); *B65D 5/4266* (2013.01)

(58) Field of Classification Search

CPC ..... B65D 75/06; B65D 5/0281; B65D 5/029; B65D 5/04; B65D 5/5004; B65D 85/20; B65D 5/5007; B65D 5/5045; B65D 2571/00882

USPC ..... 229/151, 110, 161; 206/418, 434, 521

See application file for complete search history.

(56) References Cited

U.S. PATENT DOCUMENTS

| | | | |
|---|---|---|---|
| 1,168,565 | A | 1/1916 | Rosenwald |
| 2,723,795 | A | 11/1955 | Douglas |
| 3,035,751 | A | 5/1962 | Brown |
| 3,111,223 | A | 11/1963 | Jacobi |
| 3,873,017 | A | 3/1975 | Blatt |
| 5,730,289 | A | 3/1998 | Cappels |
| 10,556,716 | B2 | 2/2020 | Ramos |
| 2015/0203240 | A1 | 7/2015 | Mengistu et al. |

*Primary Examiner* — Christopher R Demeree
(74) *Attorney, Agent, or Firm* — Neil G. Cohen

(57) ABSTRACT

A blank for a package configured to retain an article therein can be configured to be wrapped around the article to form a circumferential case around the article and have a longitudinal length longer than the article. The blank can be configured to define the circumferential case to include one or more inward protrusions at or near one or more ends of the circumferential case that is configured to extend into the circumferential case above and/or below the article to retain the article longitudinally.

4 Claims, 8 Drawing Sheets

Fig. 13
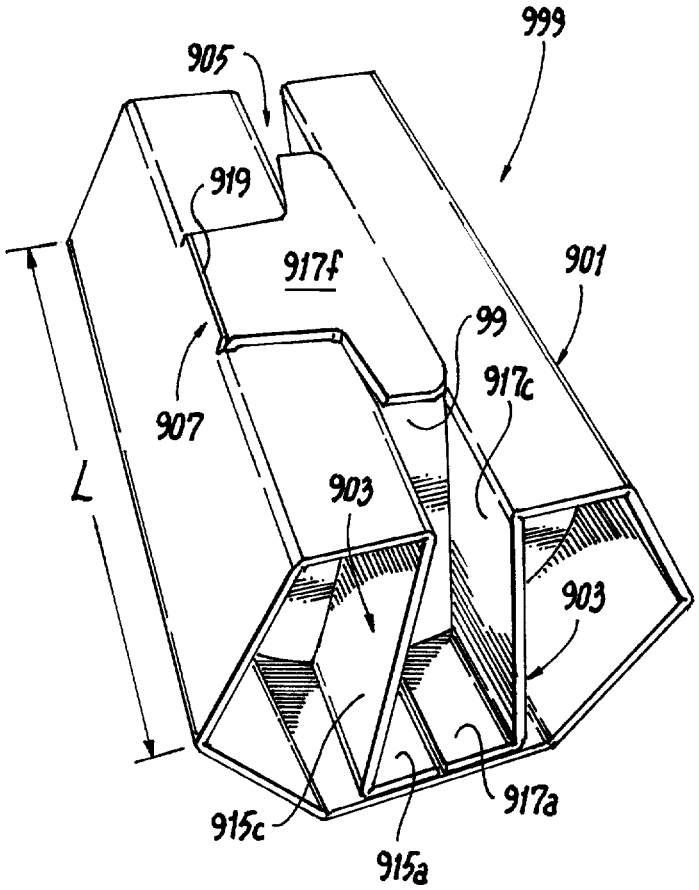
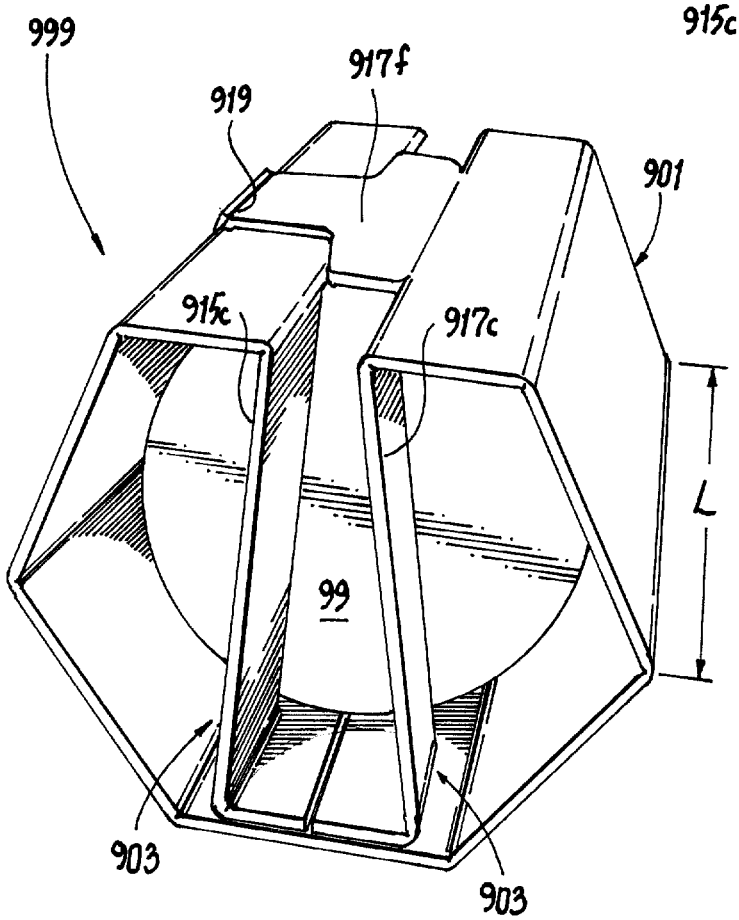
Fig. 14

PACKAGING AND BLANKS THEREFOR

CROSS REFERENCE TO RELATED APPLICATIONS

This Application is a Divisional of U.S. patent application Ser. No. 16/158,369 filed on Oct. 12, 2018. The entire contents of this application are incorporated herein by reference in their entirety.

BACKGROUND

1. Field

The present disclosure relates to packaging, more specifically to product packaging (e.g., for cylindrical objects such as candles)

2. Description of Related Art

Packaging for cylindrical products (e.g., a candle) is traditionally done in a box that is filled with packaging foam or other material. Such boxes do not conform to a shape of the product, can be time consuming to prepare from a blank, and are wasteful of packaging material and the material needed to make the box.

Such conventional methods and systems have generally been considered satisfactory for their intended purpose. However, there is still a need in the art for improved packaging and blanks therefor. The present disclosure provides a solution for this need.

SUMMARY

In accordance with at least one aspect of this disclosure, a blank for a package configured to retain an article therein can be configured to be wrapped around the article to form a circumferential case around the article and have a longitudinal length longer than the article. The blank can be configured to define the circumferential case to include one or more inward protrusions at or near one or more ends of the circumferential case that is configured to extend into the circumferential case above and/or below the article to retain the article longitudinally.

The blank can be configured to form the circumferential case to have a polygonal tube shape having a polygonal cross-sectional shape. The blank can be configured to form the circumferential case to include one or more of the inward protrusions at or near both ends of the circumferential case to retain the article between both ends of the circumferential case. In certain embodiments, the blank can be configured to form at least one latch and a receiver for each latch to latch the circumferential case around the article.

In certain embodiments, the blank can include an inner flap and an outer flap. The inner flap can include a plurality of inner flap hinges. The plurality of inner flap hinges can define a first inner panel and a second panel of the inner flap. The first inner panel and second inner panel can include one or more common cuts defined at last partially through each of the first inner panel and the second inner panel. A plurality of secondary hinges can be defined in the first inner panel and the second inner panel from an edge of the inner flap to a respective common cut to define at least one push-in subpanel configured to form one or more of the one or more inward protrusions.

The outer flap can include a plurality of outer flap hinges. The plurality of outer flap hinges can define a first outer panel and a second outer panel. The first outer panel and the second outer panel can define one or more apertures from or near an edge of the outer flap to provide a user access to each push-in subpanel when formed around the article to allow a user to selectively form the one or more inward protrusions.

In certain embodiments, the plurality of inner flap hinges can define a third inner panel and a fourth inner panel of the inner flap. The third inner panel and the fourth inner panel can include one or more common cuts defined at last partially through each of the third inner panel and the fourth inner panel. A plurality of secondary hinges can be defined in the third inner panel and the fourth inner panel from an edge of the inner flap to a respective common cut to define at least one additional push-in subpanel configured to form one or more of the one or more inward protrusions.

In certain embodiments, the first, second, third, and fourth inner panels can include two common cuts total on opposite sides of the inner flap configured to form at least one of the inner protrusions at each end of the circumferential case to retain the article between both ends of the circumferential case. The third panel can include a receiver defined therein and configured to receive a latch tab of the blank. The plurality of inner flap hinges can define a fifth inner panel between the first, second, third, and fourth inner panels.

The plurality of outer flap hinges can define a third outer panel and a fourth outer panel. The third outer panel and the fourth outer panel can define one or more additional apertures from or near an edge of the outer flap to provide a user access to the one or more additional push-in subpanels when formed around the article to allow a user to selectively form the one or more inward protrusions.

The first, second, third, and fourth outer panels can include at least two apertures total on opposite sides of the outer flap to provide access to one or more subpanels to allow a user to selectively form at least one inward protrusion at each end of the circumferential casing. The plurality of outer flap hinges define a fifth outer panel between the first, second, third, and fourth outer panels.

The plurality of outer flap hinges can define a sixth outer panel and a seventh outer panel extending from opposite lateral ends of the outer flap. The sixth outer panel can include the latch tab extending therefrom. The seventh outer panel can include a latch cut defined between the seventh outer panel and an adjacent panel and configured to allow the latch tab to be inserted through the latch cut to enter the receiver of the inner flap.

In certain embodiments, the fifth inner panel can be connected to the fifth outer panel at a flap hinge such that the inner flap can be folded over to mate with the outer flap. In certain embodiments, the inner flap can be adhered to the outer flap such that at least one panel of the inner flap is attached to at least one panel of the outer flap. The inner flap can be adhered to the outer flap such that each push-in subpanel is accessible through an aperture of the outer flap.

In certain embodiments, the blank can include a single flap having a plurality of hinges that define a plurality of panels, and at least one structure panel having a first attachment tab configured to attach to at least one of the plurality of panels when the structure panel is folded over at an adjacent hinge of the plurality of hinges. The at least one structure panel can include one or more inward protrusion panels defined by one or more cut therein and configured to form at least one of the one or more inward protrusions across the circumferential case when the attachment tab is attached to the at least one panel of the plurality of panels and when the single flap is wrapped around the article to automatically retain the article longitudinally upon forming of the circumferential case.

The blank can define a first structure panel and a second structure panel. In certain embodiments, each of the first and second structure panel can include at least two cuts total, at least one on each longitudinal side of the single flap to form at least one inner protrusion panel on each longitudinal end of the circumferential case.

The first structure panel can include a plurality of mid-section panels defined between two inward protrusion panels. The second structure can define a latch tab of the structure panel between two inward protrusion panels. A cut receiver can be defined in a hinge adjacent to the first structure panel for the latch tab to be inserted therethrough and retained thereby.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIGS. 11-13 are perspective views illustrating an embodiment of a method for packaging an article using the blank of FIG. 9 in accordance with this disclosure; and FIG. 14 shows a perspective view of an article contained within a packaging made from a blank of FIG. 9.

DETAILED DESCRIPTION

Figure 1:
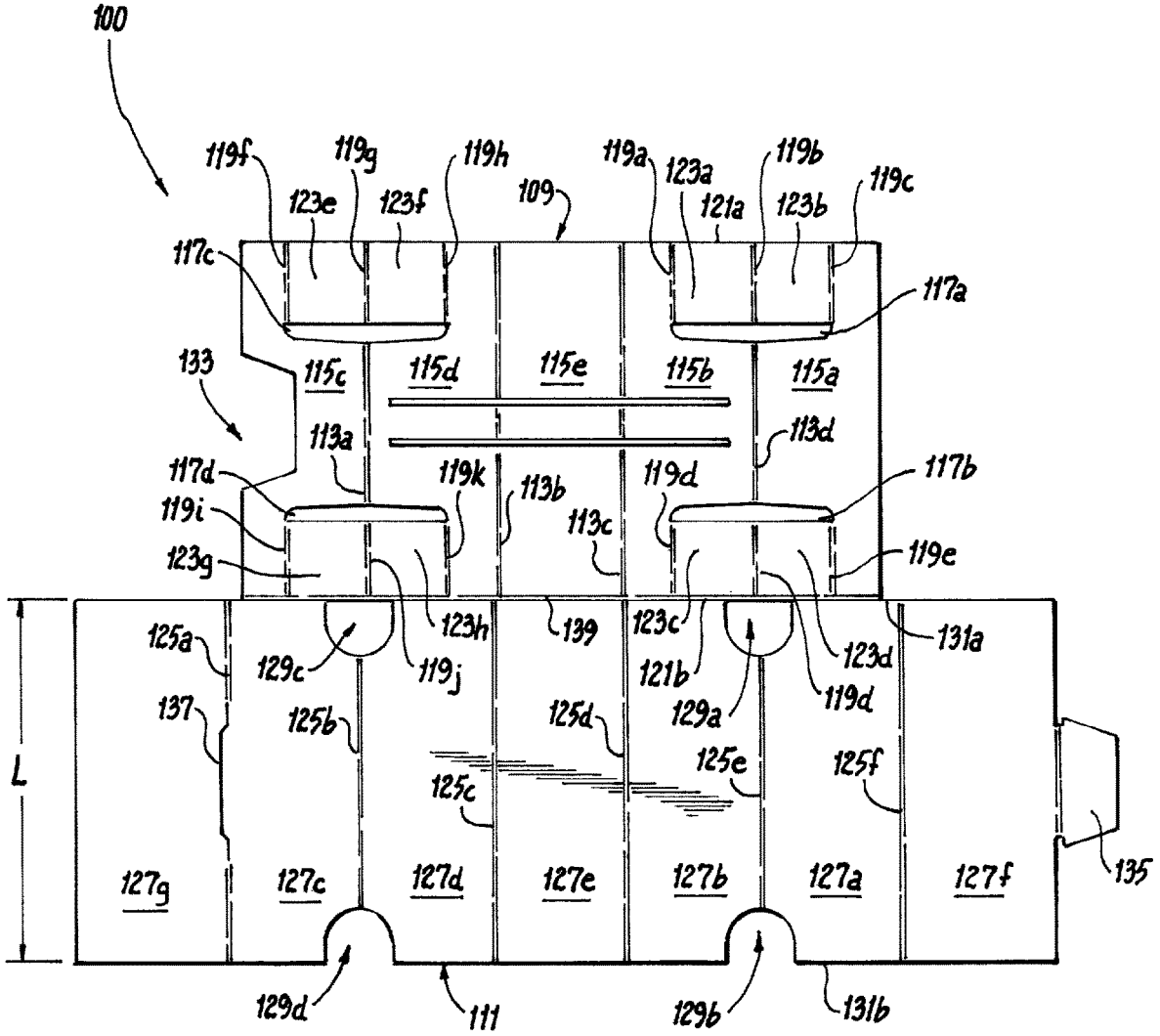
FIG. 1 is a plan view of an embodiment of a blank in accordance with this disclosure.

Reference will now be made to the drawings wherein like reference numerals identify similar structural features or aspects of the subject disclosure. For purposes of explanation and illustration, and not limitation, an illustrative view of an embodiment of a blank in accordance with the disclosure is shown in FIG. 1 and is designated generally by reference character 100. Other embodiments and/or aspects of this disclosure are shown in FIGS. 2-14.

Figure 7:
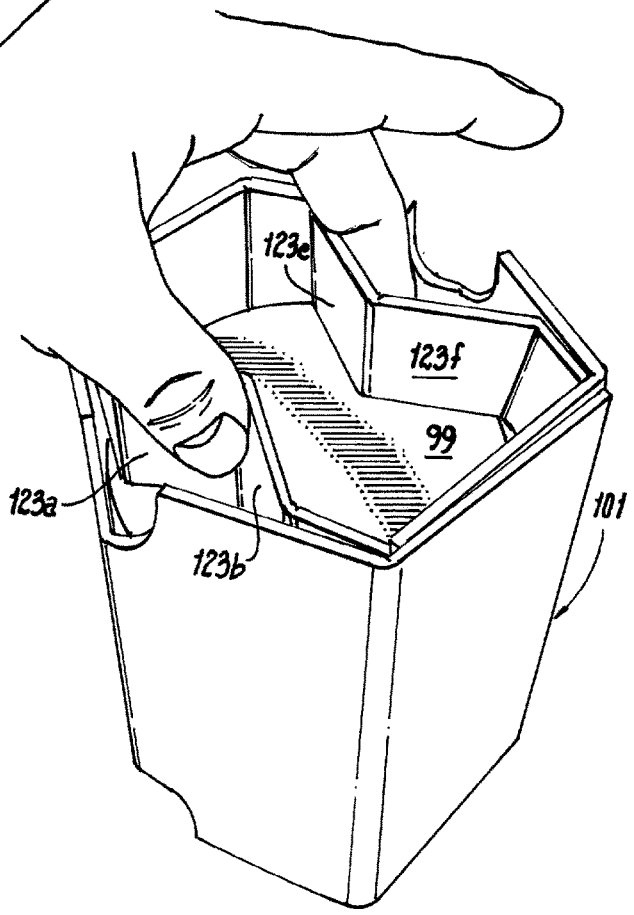
Figure 8:
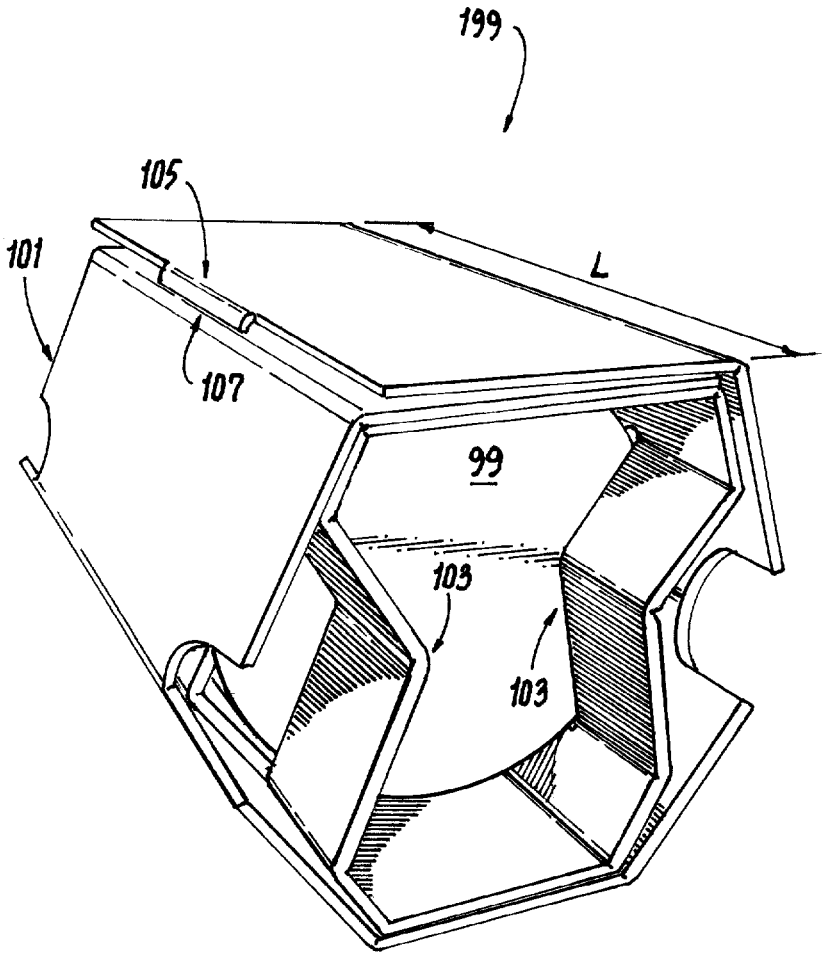
FIG. 8 shows a perspective view of an article contained within a packaging made from a blank of FIG. 1.
Figure 9:
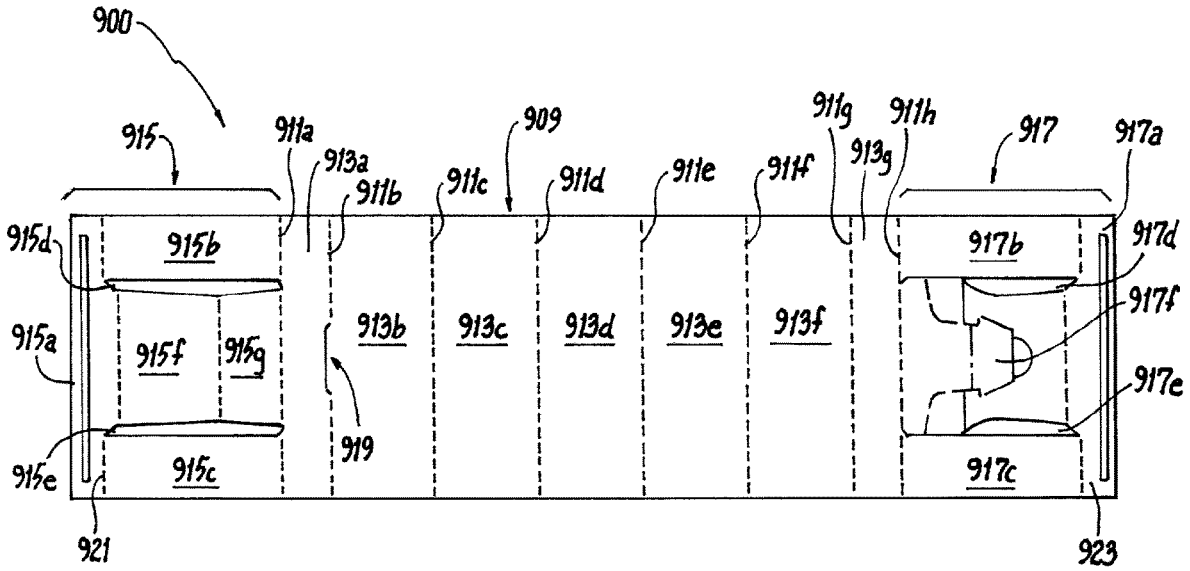
FIG. 9 is a plan view of another embodiment of a blank in accordance with this disclosure.

Referring generally to FIGS. 1-14, in accordance with at least one aspect of this disclosure, a blank (e.g., blank 100 as shown in FIG. 1, blank 900 as shown in FIG. 9) for a package (e.g., package 199 as shown in FIG. 8, package 999 as shown in FIG. 14) configured to retain an article 99 therein can be configured to be wrapped around the article 99 to form a circumferential case (e.g., case 101 in FIG. 8, case 901 in FIG. 14) around the article 99 and have a longitudinal length "L" longer than the article 99. The blank (e.g., 100, 999) can be configured to define the circumferential case (e.g., 101, 901) to include one or more inward protrusions (e.g., protrusions 103 as shown in FIG. 8, protrusions 903 as shown in FIG. 14) at or near one or more ends of the circumferential case (e.g., 101, 901) that is configured to extend into (e.g., radially inwardly into) the circumferential case (e.g., 101, 901) above and/or below the article 99 to retain the article 99 longitudinally.

As shown, the blank (e.g., 100, 900) can be configured to form the circumferential case (e.g., 101, 901) to have a polygonal tube shape having a polygonal cross-sectional shape. The blank (e.g., 100, 900) can be configured to form the circumferential case (e.g., 101, 901) to include one or more of the inward protrusions (e.g., 103, 903) at or near both ends of the circumferential case (e.g., 101, 901) to retain the article 99 between both longitudinal ends of the circumferential case (e.g., 101, 901). In certain embodiments, the blank (e.g., 101, 901) can be configured to form at least one latch (e.g., latch 105 as shown in FIG. 8, latch 905 as shown in FIG. 14) and a receiver (e.g., receiver 107 as shown in FIG. 8, receiver 907 as shown in FIG. 14) for each latch (e.g., 105, 109) to latch the circumferential case (e.g., 101, 901) around the article 99.

Referring to the embodiment of FIGS. 1-9, in certain embodiments, a blank 100 can include an inner flap 109 and an outer flap 111. The inner flap 109 can include a plurality of inner flap hinges 113*a, b, c, d*. One or more of the plurality of inner flap hinges 113*a, b, c, d* (e.g., 113*d* as shown) can define a first inner panel 115*a* and a second panel 115*b* of the inner flap 109.

The first inner panel 115*a* and second inner panel 115*b* can include one or more common cuts 117*a*, 117*b* defined at last partially through each of the first inner panel 115*a* and the second inner panel 115*b*. The one or more common cuts 117*a*, 117*b* can be defined by an aperture as shown, or can include any suitable line cut, or breakable perforation.

One or more of a plurality of secondary hinges 119*a, b, c, d, e* can be defined in each of the first inner panel 115*a* and the second inner panel 115*b* from an edge 121*a*, 121*b* of the inner flap 109 to a respective common cut 117*a*, 117*b* to define at least one push-in subpanel 123*a, b, c, d* configured to form one or more of the one or more inward protrusions 103.

The outer flap 111 can include a plurality of outer flap hinges 125*a, b, c, d, e, f*. One or more of the plurality of outer flap hinges 125*a, b, c, d, e, f* can define a first outer panel 127*a* and a second outer panel 127*b*. The first outer panel 127*a* and the second outer panel 127*b* can define one or more apertures 129*a*, 129*b* from or near an edge 131*a*, 131*b* of the outer flap 111 to provide a user access to each of the one or more push-in subpanels 123*a, b, c, d* when formed around the article 99 to allow a user to selectively form the one or more inward protrusions 103.

In certain embodiments, the plurality of inner flap hinges (e.g., 113*a* as shown) can define a third inner panel 115*c* and a fourth inner panel 115*d* of the inner flap 109. The third inner panel 115*c* and the fourth inner panel 115*d* can include one or more common cuts 117*c*, 117*d* defined at last partially through each of the third inner panel 115*c* and the fourth inner panel 115*d*. The one or more common cuts 117*c*, 117*d* can be the same as or similar to those as described above, for example. One or more of a plurality of secondary hinges 119*f, g, h, i, j, k* can be defined in each of the third inner panel 115*c* and the fourth inner panel 115*d* from an edge 121*a*, 121*b* of the inner flap 109 to a respective common cut 117*c*, 117*d* to define at least one additional push-in subpanel 123*e*, 123*f*, 123*g*, 123*h* configured to form one or more of the one or more inward protrusions 103.

In certain embodiments, the first, second, third, and fourth inner panels 115*a, b, c, d* can include two common cuts total on opposite sides of the inner flap (e.g., only common cut 117*a* and 117*d*) configured to form at least one of the inner protrusions 103 at each end of the circumferential case 101 to retain the article 99 between both ends of the circumferential case 101.

As shown, the third panel 115*c* (e.g., an end panel) can include a receiver 133 defined therein and configured to receive a latch tab 135 (e.g., located on the outer flap 111) of the blank 100. Any suitable number of latch tabs 135 and/or receiver 133. The plurality of inner flap hinges (e.g., 113*b* and 113*c*) can define a fifth inner panel 115*e* between the first, second, third, and fourth inner panels 115*a, b, c, d*.

The plurality of outer flap hinges (e.g., hinge 125*b*) can define a third outer panel 127*c* and a fourth outer panel 127*d*. The third outer panel 127*c* and the fourth outer panel 127*d* can define one or more additional apertures 129*c*, 129*d* from or near an edge 131*a*, 131*b* of the outer flap 111 to provide a user access to the one or more additional push-in subpanels 123*e, f, g, h* when formed around the article 99 to allow a user to selectively form the one or more inward protrusions 103.

In certain embodiments, the first, second, third, and fourth outer panels 127*a, b, c, d* can include at least two apertures 129*a, b, c, d* total on opposite sides of the outer flap 111 (e.g., only aperture 129*a*, 129*b*) to provide access to one or more subpanels (e.g., subpanels 123*a*, 123*b*, 123*g*, 123*h*) to allow a user to selectively form one inward protrusion 103 at each end of the circumferential casing 101. A plurality of the outer flap hinges (e.g., hinges 125*c* and 125*d*) can define a fifth outer panel 127*e* between the first, second, third, and fourth outer panels 127*a, b, c, d*.

One or more of the plurality of outer flap hinges (e.g., 125*a* or 125*f*) an define a sixth outer panel 127*f* and a seventh outer panel 127*g* extending from opposite lateral ends of the outer flap 111. The sixth outer panel 127*f* can include the latch tab 135 extending therefrom. The seventh outer panel 127*g* can include a latch cut 137 defined between the seventh outer panel 127*g* and an adjacent panel (e.g., panel 127*c* as shown) and configured to allow the latch tab 135 to be inserted through the latch cut 137 to enter the receiver 133 of the inner flap 109. The latch cut 137 can be defined in a hinge (e.g., hinge 125*a*). Any suitable number of latch cuts 137 are contemplated herein (e.g., one for each latch tab).

Figure 2:
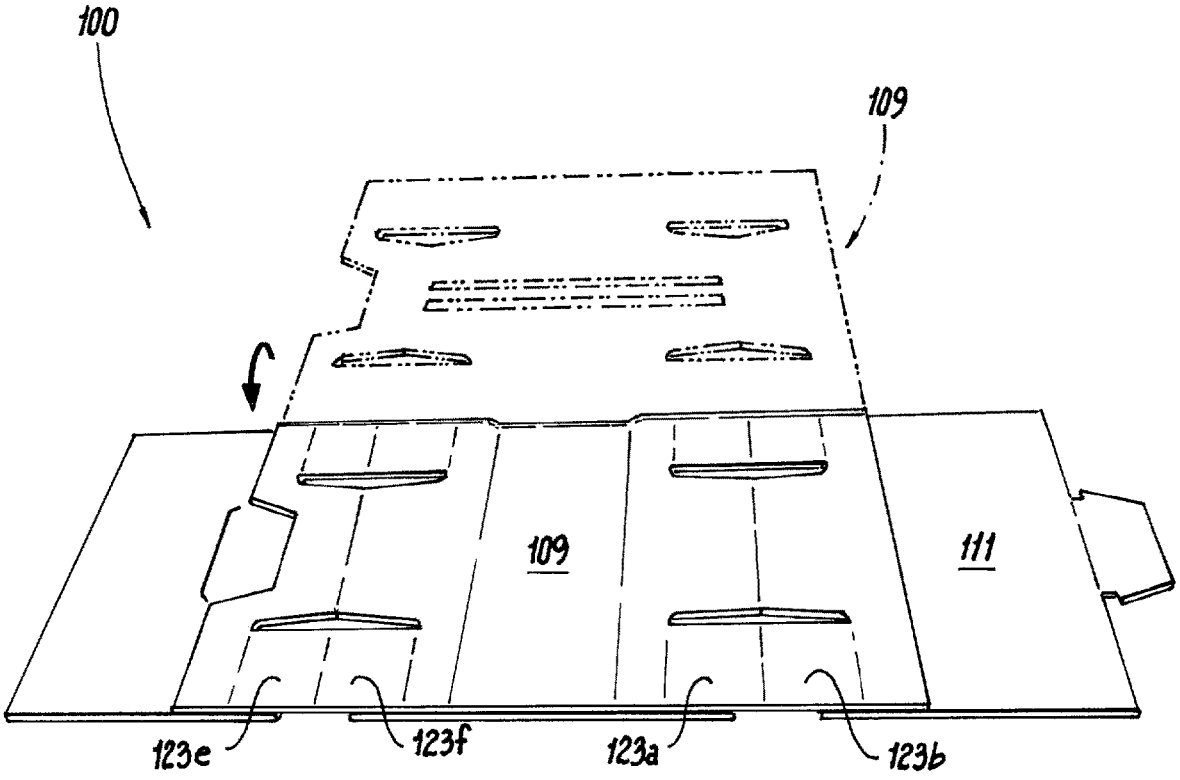
FIG. 2 is a perspective view of the blank of FIG. 1 having an inner flap contacting and/or attached to an outer flap, showing the inner flap being folded from a flat position (shown in phantom) to the folded position to contact the outer flap.

In certain embodiments, the fifth inner panel 115*e* can be connected to the fifth outer panel 127*e* at a flap hinge 139 such that the inner flap 109 can be folded over to mate with the outer flap 111 as shown in FIG. 2. In certain embodiments, the inner flap 109 can be adhered to the outer flap 111 such that at least one panel (e.g., panel 115*e*, or panels 115*b, d*, and *e*) of the inner flap 109 is attached to at least one panel (e.g., panel 127*e*, or panels 127*b, d*, and *e*) of the outer flap 111. The inner flap 109 can be adhered to the outer flap 111 such that each push-in subpanel 123*a*-123*h* is accessible through an aperture 129*a*-129*d* of the outer flap 111.

Figure 3:
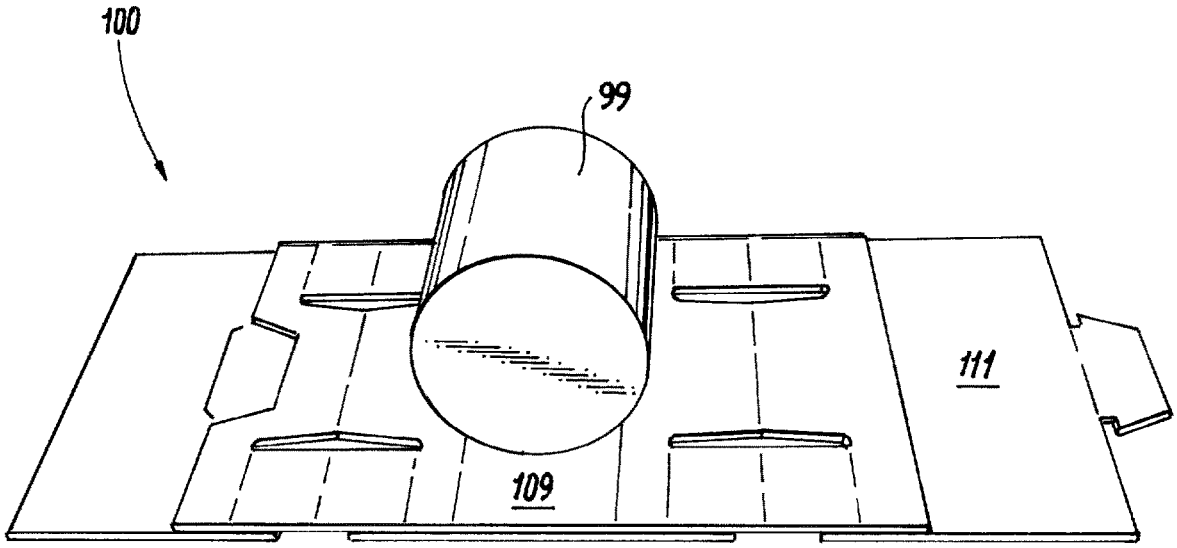
FIGS. 3-7 are perspective views illustrating an embodiment of a method for packaging an article using the blank of FIG. 1 in accordance with this disclosure.
Figure 4:
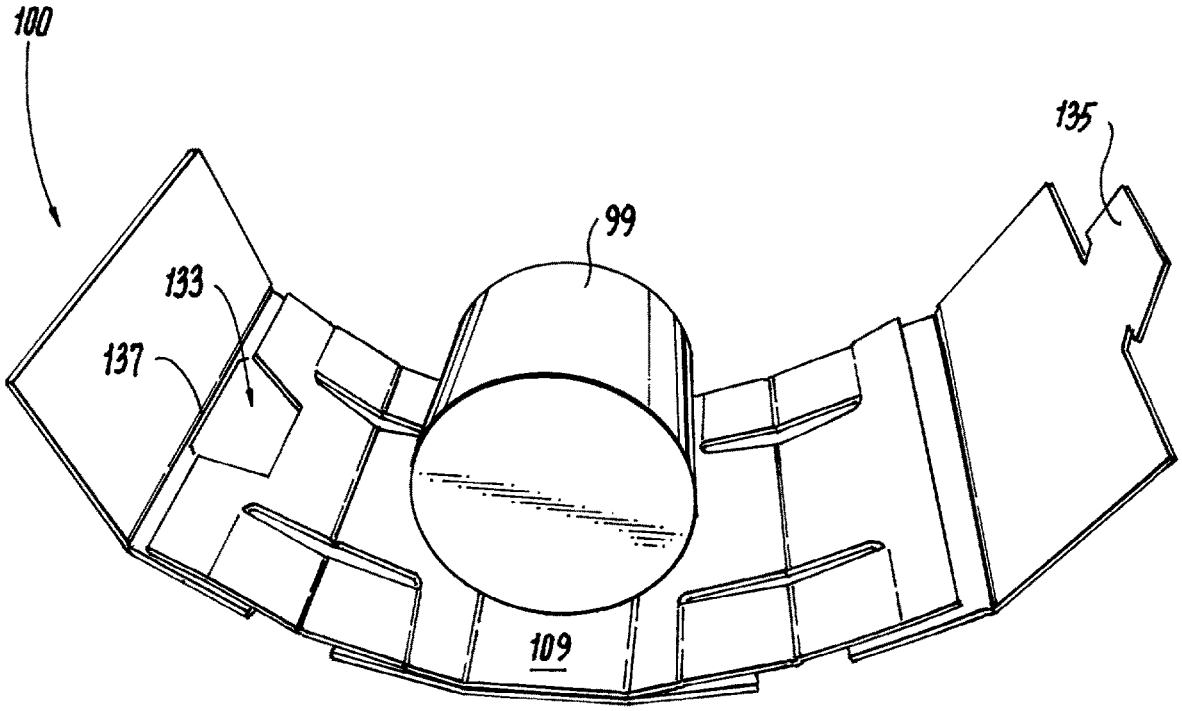
Figure 5:
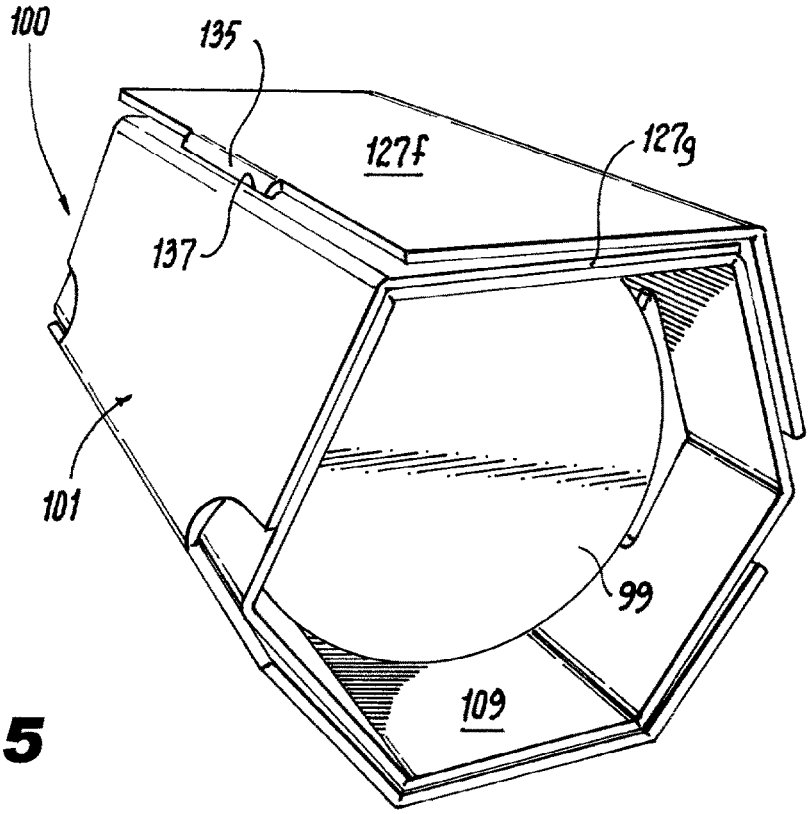
Figure 6:
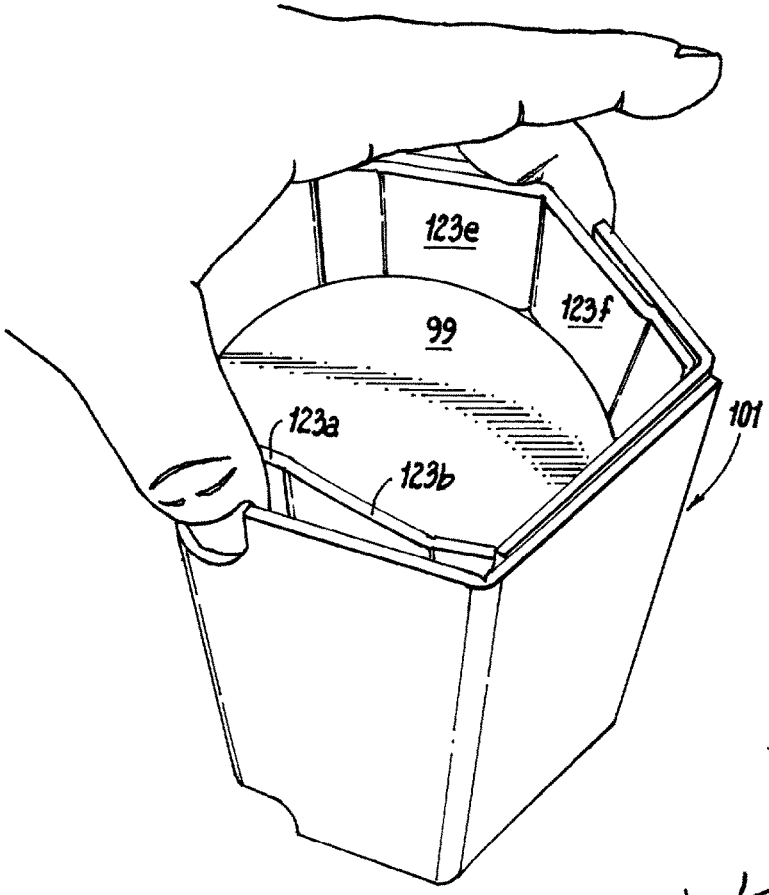

Referring to FIGS. 3-8, an article 99 can be placed on the blank 100 after the inner flap 109 is contacting and/or adhered to the outer flap 111 as shown, for example, as shown in FIG. 3. The assembled blank 100 can then be folded around the article 99 to form the circumferential casing 101 as shown in FIGS. 4 and 5. The panel 127*f* can overlap panel 127*g* and a latch tab 135 can be inserted into the latch cut 137 to lock the circumferential casing 101. As shown in FIGS. 6 and 7, the inward protrusions 103 can be formed by pushing in the push-in subpanels 123*a*, 123*b*, 123*e*, 123*f* as shown. The same can be performed on the push-in subpanels 123*c, d, g*, and *h* on the reverse longitudinal side and the package 199 can be completed to retain the article 99.

Figure 10:
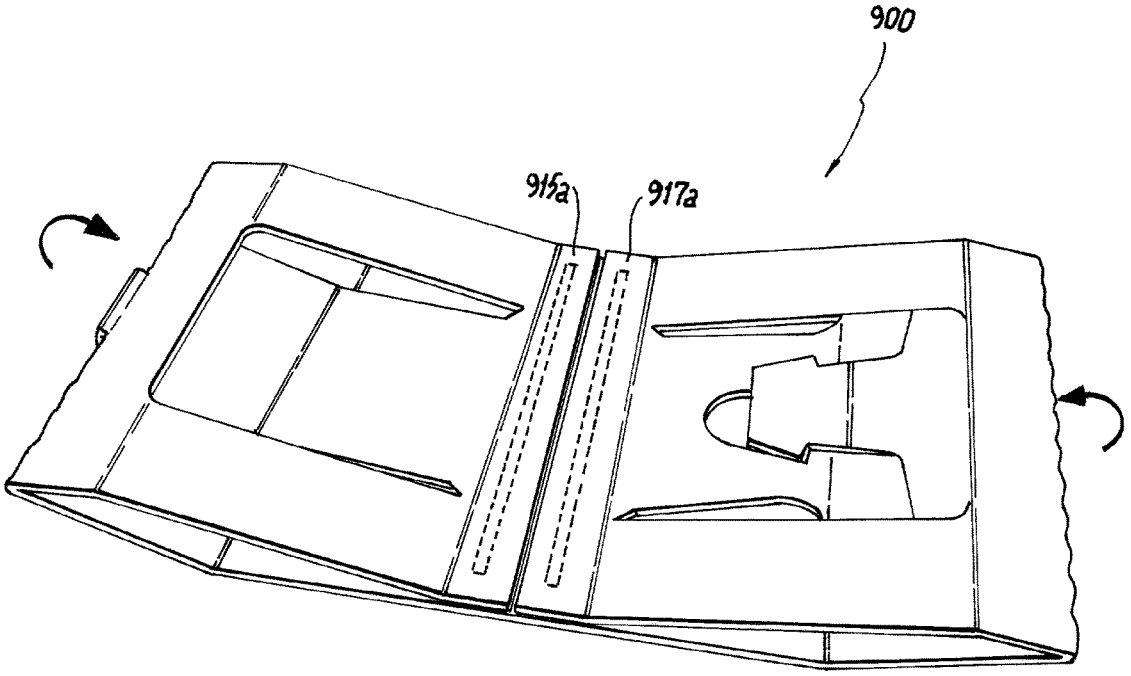
FIG. 10 is a perspective view of the blank of FIG. 9, shown in a folded state and having attachment tabs attached to a panel of the blank.

Referring to FIGS. 9-14, in certain embodiments, a blank 900 can include a single flap 909 having a plurality of hinges 911*a, b, c, d, e, f, g, h* that define a plurality of panels 913 *a, b, c, d, e, f, g*. The blank 900 can include one or more structure panels, e.g., a first structure panel 915 and a second structure panel 917. The first structure panel 915 can include a first attachment tab 915*a* configured to attach to at least one of the plurality of panels 913*a*-*g* (e.g., center panel 913*d*) when the first structure panel 915 is folded over at an adjacent hinge (e.g., 911*a* and/or 911*b*) of the plurality of hinges 911*a*-*h* (e.g., as shown in FIG. 10). The second structure panel 917 can include a first attachment tab 917*a* configured to attach to at least one of the plurality of panels 913*a*-*g* (e.g., center panel 913*d*) when the first structure panel 917 is folded over at an adjacent hinge (e.g., 911*h* and/or 911*g*) of the plurality of hinges 911*a*-*h* (e.g., as shown in FIG. 10). The first attachment tab 915*a* and the second attachment tab 917*a* can be attached to their respective structure panels 915, 917 by an attachment hinge 921, 923.

The at least one or more structure panels, e.g., 915, 917 can include one or more inward protrusion panels 915*b, c* and 917*b, c* defined by one or more cut 915*d*, 915*e* and 917*d*, 915*e* therein. The inward protrusion panels 915*b*, 915*c* and 917*b*, 917*c* can be configured to form the one or more inward protrusions 903, e.g., across the circumferential case 901 when the one or more attachment tabs 915*a*, 917*a* are attached to the at least one panel e.g., panel 913*d*, of the plurality of panels 913*a*-*g* and when the single flap 900 is wrapped around the article 99 to automatically retain the article 99 longitudinally upon forming of the circumferential case 901.

As shown, the blank 900 can define a first structure panel 915 and a second structure panel 917. In certain embodiments, each of the first and second structure panels 915, 917 can include at least two cuts total (e.g., only cut 917*d* and cut 915*c*), at least one on each longitudinal side of the single flap 909 to form at least one inner protrusion panel (e.g., only 917*b* and 915*c*) on each longitudinal end of the circumferential case 901. Any suitable number of cuts and panels is contemplated herein.

The first structure panel 915 can include a plurality of midsection panels 915*f*, 915*g* defined between two inward protrusion panels 915*b*, 915*c*. The second structure panel 917 can define a latch tab 917*f* of the structure panel 917 between two inward protrusion panels 917*b*, 917*c*. A cut receiver 919 can be defined in a hinge (e.g., hinge 911*b*) adjacent to the first structure panel 915 for the latch tab 917*f* to be inserted therethrough and retained thereby. The latch tab 917*f* can be defined by one or more breakable connections (e.g., a score line or perforation) and/or cuts to be partially lifted (e.g., by inserting a finger into an adjacent hole to get under the latch tab 917*f*) from the structure panel 917 and/or hinged around a hinge (e.g., hinge 911*h* as shown) to be rotatable relative to the second structure panel 917. In certain embodiments, the latch tab 917 can include one or more sub hinges (e.g., at an arrowhead portion thereof).

Figure 11:
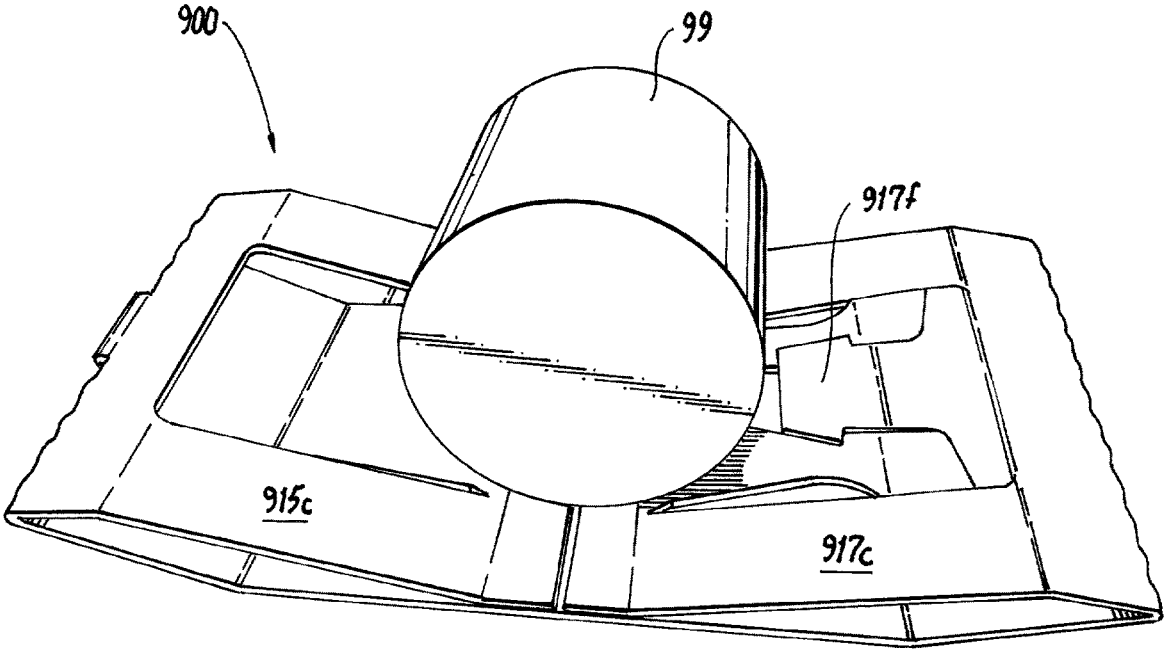
Figure 12:
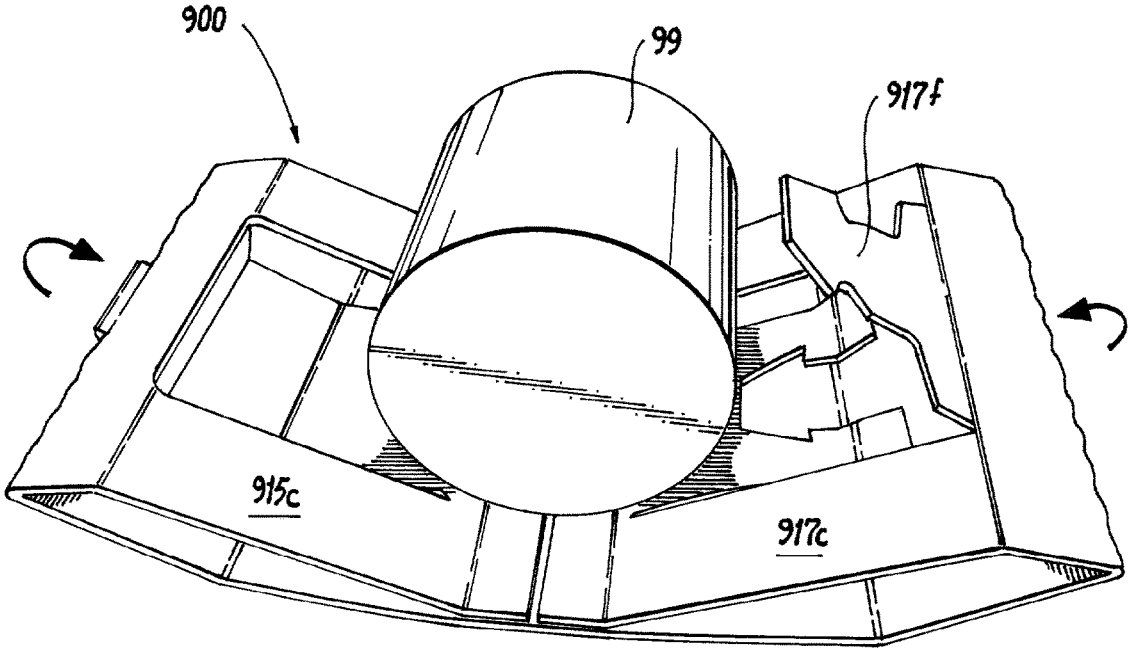

Referring to FIGS. 10-14, a blank 900 can be folded over to be assembled. The attachment tabs 915*a*, 917*a* can be attached to one or more panels (e.g., center panel 913*d* as shown) e.g., with tape and/or adhesive for example. As shown in FIG. 11, an article 99 can be placed on the assembled blank 900 and the blank 900 can be folded around the article 99 while lifting the attachment tab 917*f* above the article 99 as shown in FIG. 12. In doing so, the one or more inward protrusions 103 can be formed due to the relationship of the panels as shown in FIGS. 13 and 14. The package 999 can be secured by inserted the attachment tab 917*f* into the receiver 919.

Certain embodiments include a single protective sleeve or wrap that provides protection on all sides of an item, e.g., round articles with a flat top and bottom such as a glass candle jar, for example. Embodiments can be used in conjunction with any additional shipping box or any other suitable transporting container.

Certain embodiments provide a protective wrap that can be designed in a way as to provide a double layer (e.g., where overlapping panels exist) of material protection around the perimeter of an object and additional pop ins at the top and bottom to create an area for cushioning using the open space or air cell. Certain embodiments allow the simple folding around the object to form the top and bottom air cells automatically. Certain embodiments allow a handler to pop in the top and bottom air cell feature manually.

Embodiments can be used to quickly and securely contain certain articles (e.g., round or cylindrical shapes). The invention may be used in, e.g., any industry that ships fragile jar type items. Embodiments can be utilized to contain any article type having any suitable shape.

As disclosed herein, any and/or all hinges can be any suitable hinge and can be or include any suitable indentation, perforation, and/or score line. Any aperture or cut disclosed herein can be defined in the blank as a removable portion by defining the aperture or cut with a breakable connection (e.g., a score line or perforations). Any suitable embodiments can be made from paper, plastic, and/or any other suitable material. Any suitable number of panels can be utilized herein and any panels can include any suitable shape. Any suitable latch and/or retainer disclosed herein can include any suitable shape to perform an associated function. Embodiments can include any suitable dimension and/or any additional panels, and/or hinges, and/or cuts configured to retain any suitable article (e.g., a distance between inward protrusions can be about equal to or greater than the length of the article).

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

Any suitable combination(s) of any disclosed embodiments and/or any suitable portion(s) thereof are contemplated herein as appreciated by those having ordinary skill in the art.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A blank for a package configured to retain an article therein, the blank configured to be wrapped around the article to form a circumferential case around the article having a longitudinal length longer than the article, wherein the blank is configured to define the circumferential case to include one or more inward protrusions at or near one or more ends of the circumferential case that is configured to extend into the circumferential case above and/or below the article to retain the article longitudinally, wherein the blank includes a single flap having a plurality of hinges that define a plurality of panels, and at least one structure panel having a first attachment tab configured to attach to at least one of the plurality of panels when the structure panel is folded over at an adjacent hinge of the plurality of hinges, the at least one structure panel including one or more inward protrusion panels defined by one or more cut therein and configured to form at least one of the one or more inward protrusions across the circumferential case when the attachment tab is attached to the at least one panel of the plurality of panels and the single flap is wrapped around the article to automatically retain the article longitudinally upon forming of the circumferential case.

2. The blank of claim 1, wherein the blank defines a first structure panel and a second structure panel.

3. The blank of claim 2, wherein each of the first and second structure panels includes at least two cuts total, at least one on each longitudinal side of the single flap to form at least one inner protrusion panel on each longitudinal end of the circumferential case.

4. The blank of claim 3, wherein the first structure panel includes a plurality of midsection panels defined between two inward protrusion panels, and the second structure panels defines a latch tab of the second structure panel between two inward protrusion panels, wherein a cut receiver is defined in a hinge adjacent to the first structure panel for the latch tab to be inserted therethrough and retained thereby.

* * * * *